United States Patent [19]

Fleisher et al.

[11] Patent Number: 4,711,254

[45] Date of Patent: Dec. 8, 1987

[54] CIGAR HOLDER

[76] Inventors: Nathaniel Fleisher, 8361 NW. 29th Street, Sunrise, Fla. 33322; George Spector, 233 Broadway, Rm. 3615, New York, N.Y. 10007

[21] Appl. No.: 839,640

[22] Filed: Mar. 14, 1986

[51] Int. Cl.[4] ..... A24F 7/02; A24F 13/08

[52] U.S. Cl. ..... 131/189; 131/198.2; 131/187; 131/190; 131/255

[58] Field of Search ..... 131/175, 187–189, 131/198.2, 233, 190, 253–255, 228, 229, 260, 361, 338, 198.1

[56] References Cited

U.S. PATENT DOCUMENTS

| | | | |
|---|---|---|---|
| 702,182 | 6/1902 | Bragdan | 131/187 |
| 820,777 | 5/1906 | Grice et al. | 131/189 |
| 924,316 | 6/1909 | Burger | 131/189 |
| 1,527,991 | 3/1925 | Murphy | 131/190 |
| 1,657,919 | 1/1928 | Dunn | 131/190 |
| 2,224,588 | 12/1940 | Bluhm | 131/361 |
| 2,337,925 | 12/1943 | Pomerantz | 131/188 |
| 2,910,072 | 10/1959 | Loomis | 131/254 |
| 3,503,406 | 3/1970 | Riegel et al. | 131/198.2 |

*Primary Examiner*—V. Millin
*Assistant Examiner*—H. Macey

[57] ABSTRACT

A cigar holder is provided and consists of a thin cylindrical-shaped tube that can be inserted within a mouth of a smoker. The tube has a hollow punch extending centrally inwardly to pierce butt end of a cigar for allowing free drawing of smoke. The thin cylindrical-shaped tube can be chewed on without harm to teeth of the smoker. The tube is provided with an adapter for holding variously sized cigars.

2 Claims, 8 Drawing Figures

CIGAR HOLDER

BACKGROUND OF THE INVENTION

The instant invention relates generally to mouth pieces and more specifically it relates to a cigar holder.

Numerous mouth pieces have been provided in prior art that are adapted to clip onto the ends of cigars to isolate the cigars from mouths. For example, U.S. Pat. Nos. 649,225; 924,316 and 2,910,072 all are illustrative of such prior art. While these units may be suitable for the particular purpose to which they address, they would not be as suitable for the purposes of the present invention as heretofore described.

SUMMARY OF THE INVENTION

A principle object of the present invention is to provide a cigar holder that will overcome the shortcomings of the prior art devices.

Another object is to provide a cigar holder made of soft plastic in which teeth can clamp over whereby the holder will give when chewed on and not harm the teeth.

An additional object is to provide a cigar holder that has a built-in adapter so that various sized cigars can be held thereto.

A further object is to provide a cigar holder that is simple and easy to use.

A still further object is to provide a cigar holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
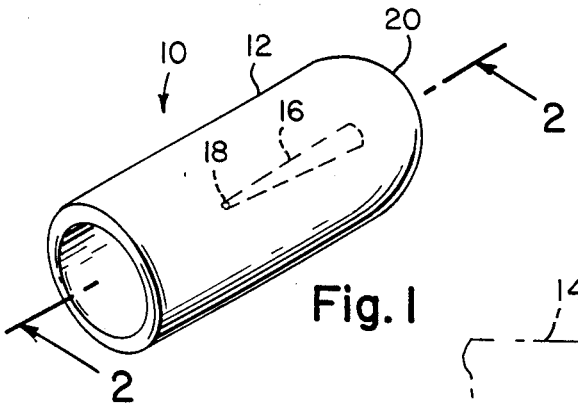
FIG. 1 is a perspective view of the invention.
Figure 2:
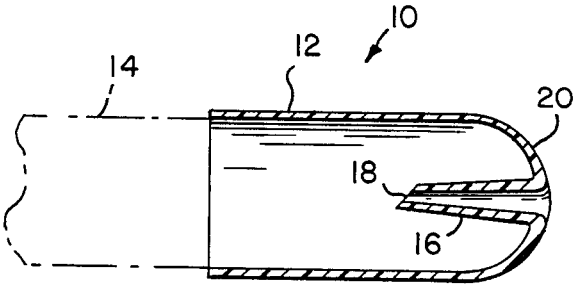
FIG. 2 is a cross sectional view taken along line 2—2 in FIG. 1.

Turning now descriptively to the drawings, in which similar reference characters denote similar elements throughout the several views, FIGS. 1 and 2 illustrate a cigar holder 10 that consists of a thin cylindrical-shaped tube 12 formed of pliable material, such as plastic, adapted to receive butt end of a cigar 14. The thin cylindrical-shaped tube has a hollow punch 16 with beveled shaped point 18 formed at end 20 thereof. The thin cylindrical-shaped tube 12 is inserted within a mouth of a smoker. The punch 16 extending centrally inwardly to pierce the butt end of the cigar 14 for allowing free drawing of smoke. The thin cylindrical-shaped tube 12 can be chewed on without harm to teeth of the smoker.

Figure 3:
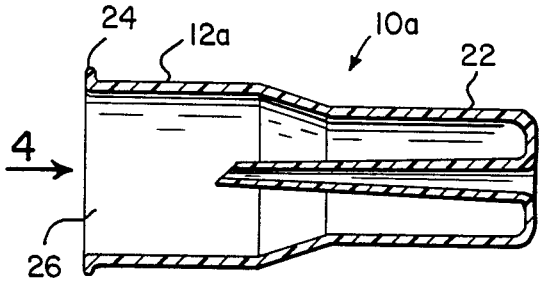
FIG. 3 is a cross sectional view similar to FIG. 2 showing a modification having a reduced flatened portion.
Figure 4:
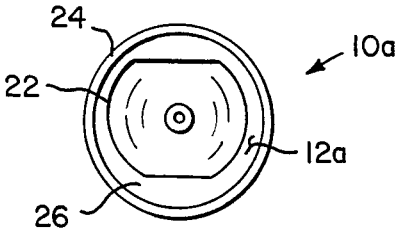
FIG. 4 is an end view taken in the direction of arrow 4 in FIG. 3.

FIGS. 3 and 4 show a modified cigar holder **10*a* wherein the thin cylindrical-shaped tube 12*a* has a reduced flatened portion 22 to allow the smoker to close the mouth further thereon. A drip ring 24 is formed around open end 26 thereof to prevent moisture from the mouth to wet the cigar 14**.

Figure 5:
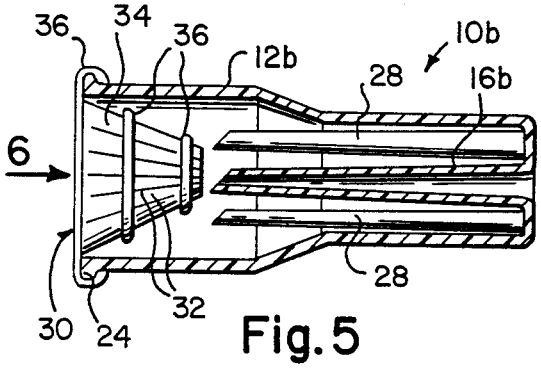
FIG. 5 is a cross sectional view similar to FIG. 2 showing another modification having a plurality of punches around center punch, and an adapter for holding various sized cigars wherein the adapter also functions as a sealing device.
Figure 6:
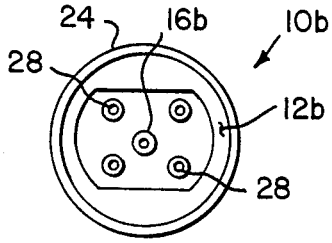
FIG. 6 is an end view taken in the direction of arrow 6 in FIG. 5 with adapter removed.

FIGS. 5 and 6 show another modified cigar holder **10*b*. The thin cylindrical-shaped tube 12*b* has a plurality of hollow punches 28 formed around the center punch 16*b* to allow for more free drawing of smoke from the cigar 14. A funnel shaped adapter 30 is provided and has a plurality of slots 32 to form fingers 34 thereon. The adapter 30 snaps onto the drip ring 24 at 36 and extends centrally inwardly for holding various sized cigars 14. Two elastic bands 36 fit around the fingers 34 of the adapter 30** to function as sealing devices of the adapter.

Figure 7:
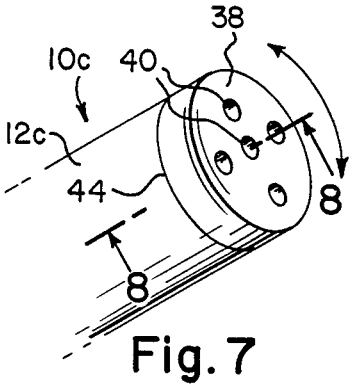
FIG. 7 is a partial perspective view showing yet another modification having a rotating end cap with holes to open and cover in various combination the apertures of the punches therein.
Figure 8:
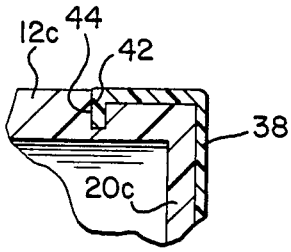
FIG. 8 is an enlarged cross sectional view taken along line 8—8 in FIG. 7 showing how the cap is rotatably held thereon.

FIGS. 7 and 8 show still another modified cigar holder **10*c* containing an end cap 38 that has a plurality of holes 40 to open and cover in various combinations apertures of the punches therein. The end cap 38 has an annular flange 42 rotatably held to the end 20*c* of the thin-cylindrical-shaped tube 12*c* that has an annular groove 44**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A cigar holder comprising a thin cylindrical shaped tube formed of pliable material and adapted at a first open end to receive the butt end of a cigar, said tube further having a second closed mouth end having a plurality of apertures formed therein, said tube further having a plurality of substantially parallel hollow tubular punch members, each punch member extending inwardly from one of said apertures and being provided with a beveled point at the inward end thereof adapted to pierce the butt end of said cigar and to allow free drawing of smoke through the respective punch, one of said punch members substantially coaxial with said tube, said tube further having a drip ring formed around the outer portion of said first open end adapted to prevent moisture from the mouth of the user from wetting the cigar, said tube having a reduced cross section toward the second mouth end thereof, a funnel shaped adapter extending centrally inwardly from said first end and having means for removably securing the adapter onto said drip ring, said adapter further having a plurality of slots forming fingers therebetween, thereby providing a means for holding variously sized cigars, said adapter also being provided with elastic bands around said fingers.

2. A cigar holder as recited in claim 1, further comprising an end cap having a plurality of holes arranged to provide a means to open and cover in various combinations said apertures, said end cap having an annular flange rotatably held to an annular groove in said second mouth end of said thin cylindrical shaped tube.

* * * * *